US007683744B2

(12) United States Patent
Mahlandt et al.

(10) Patent No.: US 7,683,744 B2
(45) Date of Patent: Mar. 23, 2010

(54) RADIO FREQUENCY WAVEGUIDE COMPRISING AN ELECTRIC CONDUCTOR MADE OF A PLASTIC FOIL LAYER LAMINATED WITH A ELECTRIC CONDUCTIVE MATERIAL LAYER

(75) Inventors: Erhard Mahlandt, Laatzen (DE); Olaf Mientkewitz, Ronnenberg (DE); Gurgen Harutyunyan, Hannover (DE)

(73) Assignee: Alcatel Lucent, Paris (FR)

( * ) Notice: Subject to any disclaimer, the term of this patent is extended or adjusted under 35 U.S.C. 154(b) by 100 days.

(21) Appl. No.: 11/638,487

(22) Filed: Dec. 14, 2006

(65) Prior Publication Data

US 2007/0171007 A1 Jul. 26, 2007

(30) Foreign Application Priority Data

Jan. 20, 2006 (EP) ..... 06290148

(51) Int. Cl.
*H01P 3/14* (2006.01)
*H01P 11/00* (2006.01)

(52) U.S. Cl. ..... 333/241; 29/600; 333/243

(58) Field of Classification Search ..... 333/239, 333/241, 242, 243; 29/600; 138/139
See application file for complete search history.

(56) References Cited

U.S. PATENT DOCUMENTS

| | | | | |
|---|---|---|---|---|
| 2,783,440 | A * | 2/1957 | Lovick, Jr. | 333/239 |
| 3,195,079 | A * | 7/1965 | Burton et al. | 333/239 |
| 3,234,489 | A * | 2/1966 | Hahne | 333/239 |
| 3,336,544 | A * | 8/1967 | Krauk et al. | 333/241 |
| 3,648,201 | A * | 3/1972 | Gissel | 333/241 |
| 3,692,063 | A | 9/1972 | Wagele | |
| 3,720,994 | A | 3/1973 | Wagele | |
| 4,020,875 | A * | 5/1977 | Akiba | 138/128 |
| 4,071,834 | A | 1/1978 | Comte et al. | |
| 4,117,260 | A | 9/1978 | Wilkenloh et al. | |
| 4,307,756 | A * | 12/1981 | Voigt et al. | 138/149 |
| 2003/0174030 | A1 | 9/2003 | Chopra et al. | |

FOREIGN PATENT DOCUMENTS

| | | |
|---|---|---|
| DE | 20 56 352 A1 | 5/1972 |
| GB | 1 470 080 A | 4/1977 |
| GB | 1 598 001 A | 9/1981 |

OTHER PUBLICATIONS

Patent Abstracts of Japan vol. 7, No. 264 (E-212), Nov. 24, 1983.
Patent Abstracts of Japan vol. 2000, No. 10, Nov. 17, 2000.
Patent Abstracts of Japan vol. 2003, No. 10, Oct. 8, 2003.
Patent Abstracts of Japan vol. 2000, No. 10, Sep. 22, 2000.

* cited by examiner

*Primary Examiner*—Benny Lee
(74) *Attorney, Agent, or Firm*—Fay Sharpe LLP

(57) ABSTRACT

A Radio-Frequency (RF) waveguide comprising at least a folded sheet (3) is described, wherein the sheet comprises a first layer made of a plastic, and at least a second layer made of a electric conductive material. Furthermore a method for manufacturing such a RF waveguide plus a device to perform said method is described.

20 Claims, 3 Drawing Sheets

RADIO FREQUENCY WAVEGUIDE COMPRISING AN ELECTRIC CONDUCTOR MADE OF A PLASTIC FOIL LAYER LAMINATED WITH A ELECTRIC CONDUCTIVE MATERIAL LAYER

BACKGROUND OF THE INVENTION

The invention is based on a priority application EP 06290148.3 which is hereby incorporated by reference.

The invention relates to a Radio-Frequency (RF) waveguide comprising at least a folded sheet.

Guiding high frequency or also called Radio Frequency (RF) electromagnetic waves takes place within transmission lines comprising e.g. a RF coaxial cable, an elliptical waveguide or another metallic tube or combinations hereof.

Today the necessary mechanical properties such as lateral pressure and tensile rigidity of RF-cables, particularly RF coaxial cables, and RF-waveguides, in the following exemplary embodiments described by the term "waveguide", are achieved using electric conductors with diameters or wall thicknesses high enough to provide the required mechanical properties. The dimensions wall thickness and/or diameter of the electric conductors are significantly higher than required to fulfill the real function of transmitting high frequency signals. The dimensions required to fulfill the real function mentioned above are defined by the so-called skin deepness or by the so-called skin effect. Guiding particularly high frequency or RF signals in the form of electromagnetic waves within a waveguide takes place in a thin region close to the surface of the electric conductor. The orientation of the surface, e.g. regarding a RF coaxial cable the inner or the outer surface, beneath which guiding of electromagnetic waves takes place is defined by the arrangement of the electric conductors relative to each other.

Using solid electric conductors leads to high weight and high costs due to high portions of metal within the waveguide.

Rising prices for raw metals such as raw copper force manufacturers to reduce the portion of copper and other metallic components within waveguides to an absolute minimum and, at the same time, to keep at least the high-frequency specifications at today's values.

From DE 2 022 991 and from DE 20 56 352 it is known to form a waveguide made of a sheet of an electric conductor that is folded to a tubular or cylindrical conductor enclosing a core. A first the tubular conductor is formed by folding a metallic sheet having the form of a strip to a tube, wherein the inner diameter of the tubular conductor is slightly larger than the outer diameter of the core. The joint between the margin regions of the sheet that are adjacent after shaping the tubular conductor are welded to avert bunching when bending the waveguide. The core is made of a prefabricated solid or a hollow-cylindrical copolymer of ethylene. The tubular conductor after completing is pulled down on the core, wherein the electric conductor and the core are laminated with each other. Particularly to allow welding of the margin regions of the sheet, a higher material thickness is required than needed according to the electric boundary conditions. Furthermore, before laminating the tubular conductor and the core, the tubular conductor has to be formed to a plain ended pipe. This also requires a material thickness much higher than needed according to the electric boundary conditions. Furthermore, the manufacturing process to form a plain ended pipe is very costly and labor intensive.

From US 2003/0174030 A1 a RF coaxial cable with cladded, tubular conductors, as well as a RF-waveguide is known, wherein each conductor includes a base layer formed of a relatively higher conductivity metallic material, such as copper, silver, or gold and a bulk layer formed of a relatively lower conductivity metallic material such as aluminum or steel. Each one of the tubular conductors are made of a sheet in the form of a strip of bulk layer coated with the base layer. After coating, the sheet is folded to a tubular conductor enclosing a core, wherein the joint between the margin regions of the sheet that are adjacent after shaping the tubular conductor are welded to avert bunching when bending the coaxial cable. The coating takes place by cladding, electrodeposition, sputtering, plating or electro plating. The drawback of this solution is the relatively high weight of the tubular conductors, the usage of relatively expensive materials to form the tubular conductors and the reduced electric conductivity of the base layer material when coating the bulk layer material, particularly when using sputtering techniques.

Trying to reduce the dimensions of the metallic electric conductors up to now lead to dramatically degradation of the mechanical properties of the waveguides.

SUMMARY OF THE INVENTION

The object of the invention is to find a remedy for the above-mentioned problem.

The object of the invention is met by a RF waveguide comprising at least a folded sheet, wherein the RF waveguide is characterized in that the sheet comprises a first layer made of a plastic foil, and at least one second layer made of a thin electric conductive material, both layers laminated with each other before folding the waveguide.

The folded sheet provides the functions of an electric conductor within the waveguide plus the functions of providing the required mechanical properties. The layer made of an electric conductive material provides the function to guide electromagnetic waves within the waveguide, wherein the plastic foil layer provides the required mechanical properties. The layer made of an electric conductive material has a thickness sufficient to allow conducting the maximum occurring currents but also considering the skin effect, i.e. being substantially equal to the skin deepness. The plastic foil layer is used as carrier providing the mechanical strength of the waveguide. Preferably copper, silver or gold are used as electric conductive material. The plastic foil layer preferably comprises a polymer foil. So it is contemplated to use a plastic foil made of e.g. Liquid Crystal Polymer, Polycarbonate, Polyphenylenesulfide, Polytetrafluorethylene, Polyetheretherketone, Polyolefin, Polyethyleneterephtalat or Polyimide.

According to the invention, the dimensions of the electric conductive material preferably are reduced to a minimal thickness required for guiding electric waves, wherein the mechanical properties of the waveguide are provided by the plastic foil supporting the electric conductive material. This minimal thickness of the electric conductive layer is defined by the skin deepness. According to the invention, compared to the state of the art, a large part of the metallic electric conductor is substituted by the plastic foil.

Therefore, it is conceivable that the combined laminated sheet includes more than one layer of electric conductive material, wherein preferably the individual layers have different electrical properties. Using layers of different electric conductive materials such as copper, silver or gold improves electric conductivity.

The RF waveguide according to the invention has the advantage over the state of the art, that it provides a conductor with reduced weight and reduced material costs. It further allows to arrange openings in the metal layer for electromagnetic radiation. Furthermore a RF waveguide according to the invention has an improved flexibility compared with the state of the art. The laminated folded sheet that comprises at least one thin layer of an electric conductive material plus a preferably elastic plastic foil layer provides improved strain quality with an improved elastic elongation compared with e.g. copper of the same material thickness like the laminated folded sheet. Due to this, a RF waveguide according to the invention comprising such a sheet provides higher bending quality compared with a waveguide of the same-dimensions with a conductor only made of copper or other metallic materials or material combinations, wherein the electrical properties remain the same.

In a preferred embodiment of the invention, the margin ends of the folded combined laminated sheet are overlapping. By overlapping the margin ends the internal space enclosed by the combined laminated sheet is totally surrounded by an electric conductive material providing a shielding similar to a solid conductor.

Preferably the margin ends of the folded combined, laminated sheet are connected with each other by hemming and/or crimping after folding the sheet to a cylindrical conductor, in order to avert bunching when bending the waveguide. By hemming and/or crimping the margin ends of the combined, laminated sheet a shielding similar to a solid conductor is achieved. Furthermore the thickness of the electric conductive material can be reduced to the required minimum predefined by the skin deepness, because compared to the state of the art, no welding takes place requiring a certain minimum thickness higher than the skin deepness.

In a preferred embodiment of the invention, the combined, laminated sheet is embossed and/or corrugated in order to improve bending properties by reducing flexural rigidity.

In another preferred embodiment of the invention, the thickness of the second layer, i.e. the thickness of the electric conductive material lies between 10 to 100 μm. Regarding the skin effect, a layer thickness of 10 to 100 μm is sufficient for guiding electromagnetic waves. Using such a thin layer of an electric conductive material is only possible in combination with a waveguide according to the invention, since hemming and/or crimping the margin regions of the combined, laminated sheet allows using much thinner electric conductive materials than required when welding the margin regions with each other according to the state of the art.

In a preferred embodiment of the invention, the plastic foil preferably is made of Polyolefin, Polyethyleneterephtalat, Polyimide or another suitable plastics like e.g. Liquid Crystal Polymer, Polycarbonate, Polyphenylenesulfide, Polytetrafluorethylene or Polyetheretherketone.

Furthermore it is conceivable, that the plastic foil is provided with additives and/or reinforcements such as fiberglass, glass powder, carbon fibers and the like. By subjoining additives and/or reinforcements to the plastic foil, mechanical properties of the foil are improved.

According to a preferred embodiment of the invention, the material of the plastic foil sustains temperatures allowing soldering the conductors of waveguides to be connected with each other. Sustaining soldering temperatures is the precondition for mounting soldered plugs and jacks providing assemblies with reduced intermodulation.

It is also conceivable that the plastic foil is provided with a fiberglass cloth. The fiberglass cloth provides fire proof properties of the conductor and the waveguide. Inserting the fiberglass cloth in the plastic foil saves an additional production step of wrapping the combined laminated sheet with a fire proof fiberglass cloth. This saves manufacturing costs.

Furthermore the combined laminated sheet preferably is wrapped with a fire proof strip or wire. For fire proof waveguides, the cable sheathing has to be made of a fire proof material unable to forward fire. Regarding a coaxial cable, a fire proof material has to protect the inflammable core and/or the inflammable dielectric from fire. This is achieved by a complete shielding of the core and/or the dielectric by using a closed metallic electric conductive material for the electric conductive layer within the combined laminated sheet. In order to avert bunching of the combined laminated sheet, the combined laminated sheet is wrapped with a fire proof strip or wire.

A particularly preferred embodiment of the invention is characterized by openings in the electric conductive layer providing radiation properties. Therefore, it is conceivable that either the combined laminated sheet provides a pattern with the desired openings or only the electric conductive layer provides the openings.

In a preferred embodiment of said invention, the openings, i.e. the pattern providing the openings are achieved by etching or silk screen process printing techniques. According to the state of the art, such a pattern is manufactured by die cutting techniques that only allow simple patterns limited on simple geometric structures. Using etching or silk screen process printing techniques allow to apply any patterns by reduced costs. Furthermore etching or silk screen process printing techniques allow only to treat the electric conductive layer. Doing so, the mechanical properties of the waveguide are not declined by arranging openings in the electric conductive material, since the plastic foil below remains unchanged.

Another part of the object of the invention is met by a method for manufacturing a RF waveguide as mentioned above, the method including the steps of:

laminating a foil of plastic with at least one electric conductive material in order to get a combined laminated sheet with at least a first layer of a plastic foil and at least a second layer of an electric conductive material, and folding the combined, laminated sheet to a substantially cylindrical, preferably tubular conductor.

Lamination takes place e.g. by using an endless stripe of a rolled sheet or foil of an electric conductive metal that is glued on an endless stripe of polymer foil in an endless manufacturing process. Within the combined laminated sheet, the layer of electric conductive material is used as electric conductor with a thickness which allows for the maximum conduction of current, but considering the skin effect, has a minimum material thickness. The polymer foil layer is used as a carrier providing the mechanical strength of the waveguide. Preferably copper, silver or gold is used as electro conductive material.

Folding the combined laminated sheet to a substantially cylindrical conductor can take place by enclosing a core of a waveguide. This core can comprise other waveguides or electric conductors but can also be of an electric insulating material. Further steps, like e.g. adding a cable sheath and the like can take place after folding the waveguide. Such steps can be performed as known from the state of the art.

According to the invention, the dimensions of the electric conductive material are reduced to its minimal thickness required for guiding electric waves, wherein the mechanical properties of the waveguide are provided by the plastic foil supporting the electric conductive material. This minimal thickness is defined by the skin deepness. According to the invention, compared to the state of the art, a large part of the metallic electric conductor is substituted by the plastic foil. This is only possible by first laminating the sheet or foil of the electric conductive material on the plastic foil and afterwards forming the waveguide by folding the laminated combined sheet to the cylindrical conductor.

Furthermore, by laminating the electric conductive material and the plastic foil the electrical properties of the electric conductive material are kept, wherein according to the state of the art, using sputtering techniques the electrical properties of the electric conductive material are lowered.

By the method according to the invention the additional advantage of a higher production line output is achieved because, compared to the state of the art, no more welding or other time consuming steps are required during manufacturing of a waveguide.

A preferred embodiment of the method according to the invention is characterized in, that after folding, the joint between the margin ends of the combined, laminated sheet that are adjacent after folding the cylindrical conductor are hemmed and/or crimped to avert bunching when bending the waveguide. Doing so it is assured that e.g. an inner conductor of a coaxial cable remains shielded also if the cable is bended several times. Furthermore by hemming and/or crimping the joint between the margin regions it is possible to reduce the thickness of the preferably metallic electric conductive material dramatically compared to the state of the art, wherein welding limited the minimum possible thickness.

According to another preferred embodiment of the method according to the invention, preferably after laminating and before folding the combined laminated sheet openings are arranged in the electric conductive layer providing radiation properties. The openings preferably are achieved by etching or silk screen process printing techniques.

In another preferred embodiment of the invention, the method mentioned above is performed by a device comprising means to laminate a foil of plastic with at least one electric conductive material in order to get a combined laminated sheet with at least a first layer of a plastic foil and at least one second layer of an electric conductive material, and means to fold said combined, laminated sheet to a substantially cylindrical, preferably tubular electric conductor.

DETAILED DESCRIPTION OF THE DRAWINGS

Figure 1:
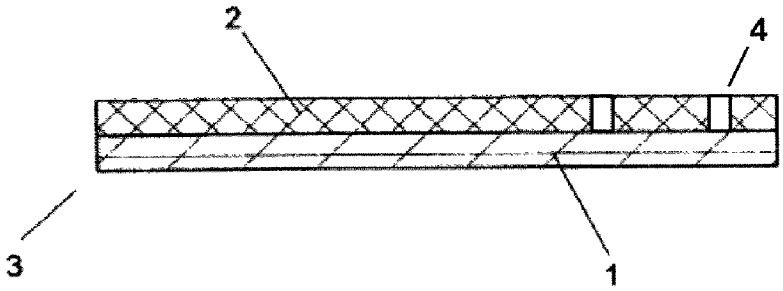
FIG. 1 showing schematically a combined laminated sheet before folding it to an electric conductor, FIG. 2 showing schematically the combined laminated sheet of FIG. 1 after folding it to an electric conductor.

According to the invention, a sheet 3 to be folded to an electric conductor within a RF waveguide basically comprises a first layer 1 that is made of a plastic foil and a second layer 2 that is made of an electric conductive material such as copper, silver or gold (FIG. 1). The plastic foil is a polyethylene foil.

Manufacturing such a sheet 3 takes place in the following way: a foil of plastic forming the first layer 1 is laminated with an electric conductive material forming the second layer 2 in order to get a combined laminated sheet with at least one layer 2 of an electric conductive material and at least one layer 1 of a plastic foil.

Lamination takes place e.g. by using an endless stripe of a rolled sheet or foil of an electric conductive material such as metal that is glued on an endless stripe of plastic, e.g. polymer foil in an endless manufacturing process. Within the combined laminated sheet, the layer of electric conductive material is used as electric conductor with a thickness allowing conducting maximum occurring currents but also considering the skin effect, i.e. having a minimum thickness. The polymer foil layer is used as a carrier providing the mechanical strength of the waveguide. Preferably copper, silver or gold is used as electro conductive material.

Figure 2:
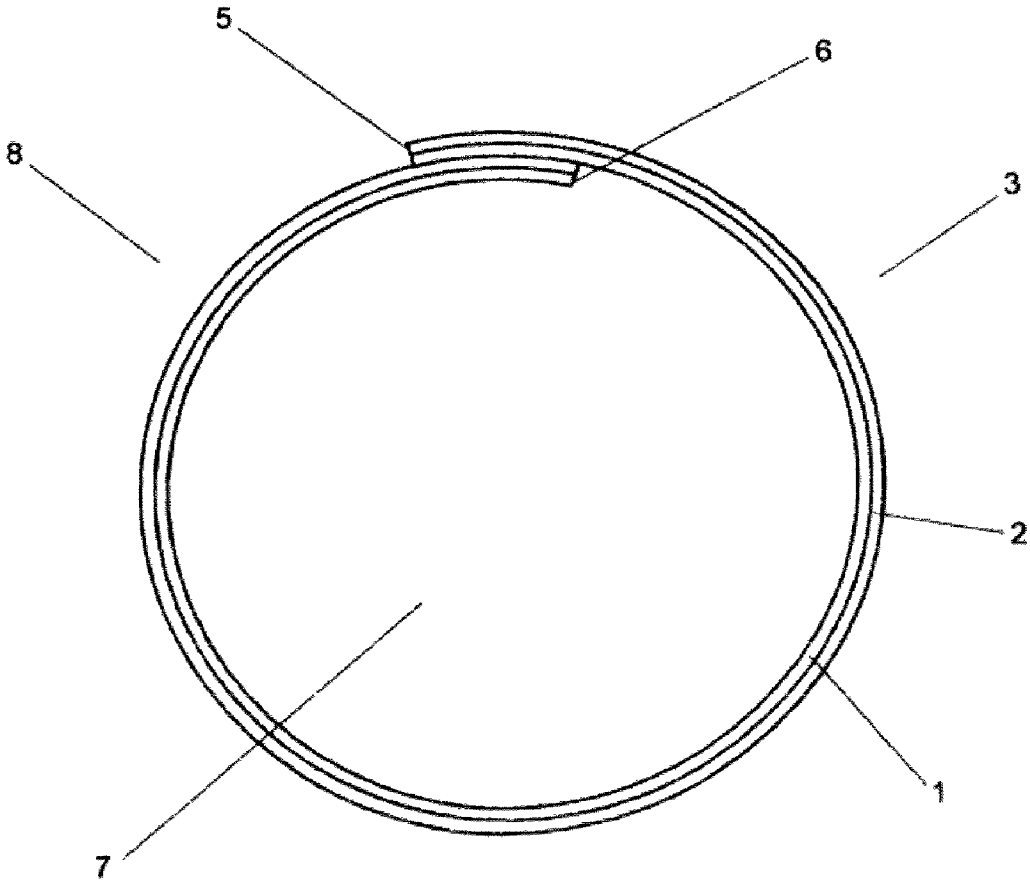

FIG. 2 shows how the combined laminated sheet 3 comprising the first layer 1 and the second layer 2 is folded to a substantially cylindrical conductor 8. The margin ends 5, 6 of the folded combined laminated sheet 3 are overlapping. By overlapping the margin ends 5, 6 the internal space 7 enclosed by the combined laminated sheet 3 is totally surrounded by an electric conductive material providing a shielding similar to a solid conductor.

Folding the combined laminated sheet 3 to a substantially cylindrical conductor 8 can take place by enclosing a core of a waveguide. This core can comprise other waveguides or electric conductors but can also be of an electric insulating material.

Figure 3A:
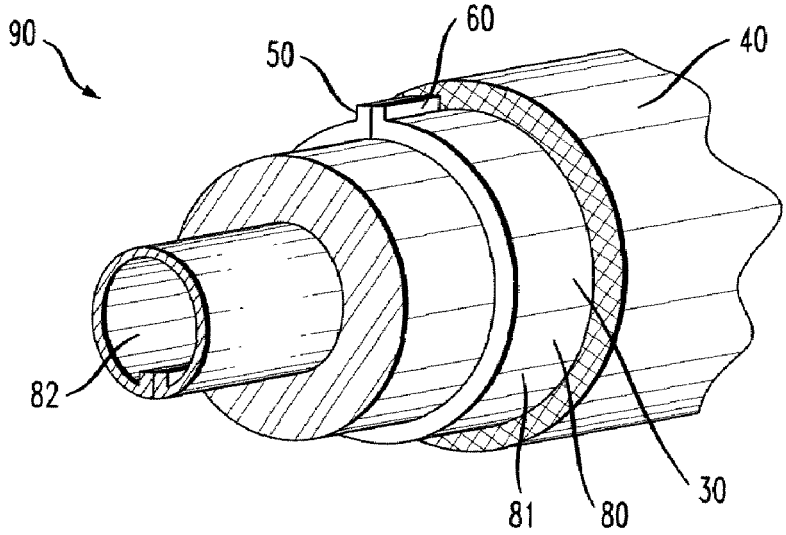
FIG. 3*a*, FIG. 3*b* and FIG. 3*c* show three different embodiments of waveguides comprising a folded combined laminated sheet.

As it can be seen in FIG. 3*a*) the margin ends 50, 60 of the combined, laminated sheet 30 are connected with each other by hemming and/or crimping after folding the sheet 30 to a cylindrical conductor 80, in order to avert bunching when bending the waveguide 90. By hemming and/or crimping the margin ends 50, 60 of the combined, laminated sheet 30 a shielding similar to a solid conductor is achieved. Furthermore, compared to the state of the art, the thickness of the electric conductive material can be reduced to the required minimum predefined by the skin deepness, because no welding takes place requiring a certain minimum thickness higher than the skin deepness. Furthermore by hemming and/or crimping after folding the sheet 30 to a cylindrical conductor 80 it is assured that the margin ends 50, 60 of the sheet 30 are electrically connected with each other. The waveguide 90 shown in FIG. 3*a*) is a RF coaxial cable having an outer cylindrical conductor 81 and an inner cylindrical conductor 82, both manufactured by the same technique according to the invention.

Figure 3B:
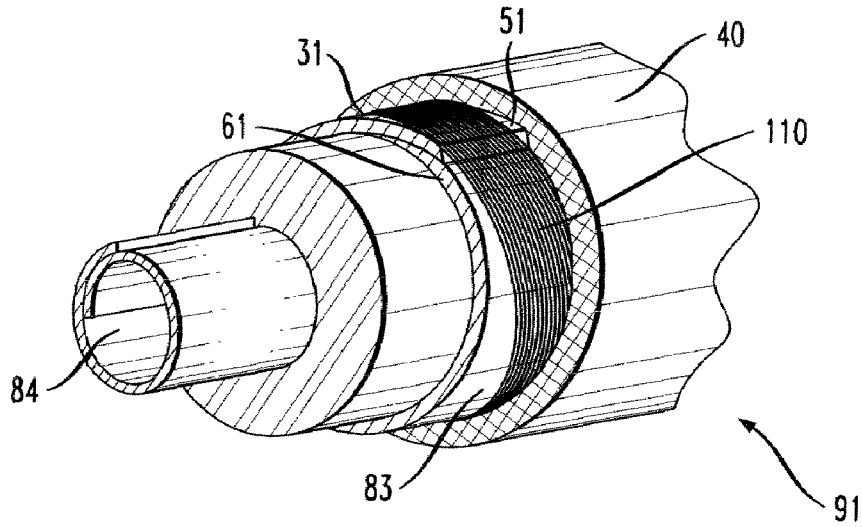

The waveguide 91 shown in FIG. 3*b*) is a RF coaxial cable having an outer cylindrical conductor 83 and an inner cylindrical conductor 84, both manufactured by the same technique according to the invention. The margin ends 51, 61 of the laminated sheet 31 are overlapping without being hemmed and/or crimped after folding the sheet 31.

Figure 3C:
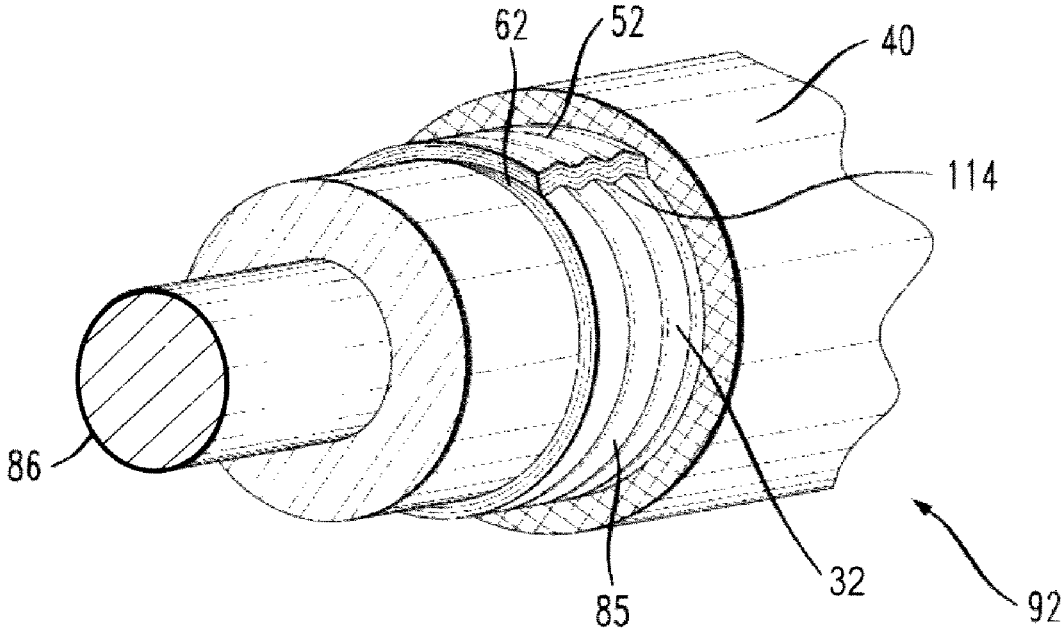

The waveguide 92 shown in FIG. 3*c*) is a RF coaxial cable having an outer cylindrical conductor 85 manufactured according to the invention and an inner cylindrical conductor 86 made of solid copper. The margin ends 52, 62 of the laminated sheet 32 are overlapping. The combined laminated sheet 32 is wrapped with a fire proof strip or wire 110.

All waveguides 90, 91, 92, shown in FIGS. 3*a*), 3*b*), 3*c*) respectively, further have an internal space totally enclosed by the particular outer cylindrical conductors 81, 83, 85, wherein the space between the inner 82, 84, 86 and the respective outer cylindrical conductors 81, 83, 85 is filled with a foam material. Furthermore the outer cylindrical conductors 81, 83, 85 are surrounded by a cable sheathing 40. Inside the inner cylindrical conductors 81, 83, a core of polyethylene is arranged.

It is important to mention, that the arrangement of the electric conductive layer and the plastic foil preferably depends on the usage of the conductor made of the combined laminated sheet. If the conductor is arranged as an inner-conductor, the electric conductive layer preferably is arranged at the outer surface of the conductor, wherein if the conductor is arranged as an outer-conductor, the electric conductive layer preferably is arranged at the inner surface of the conductor.

Doing so, the shielding that is achieved by the conductor 81 in FIG. 3*a*) is more efficient than the shielding that is achieved by the conductor 83 in FIG. 3*b*).

The invention is commercially applicable particularly in the field of production of waveguides and/or transmission lines to be used within networks for electromagnetic data transmission.

The invention claimed is:

1. Radio-Frequency (RF) waveguide comprising at least a folded laminated sheet including a first layer made of a plastic foil, and at least a second layer made of an electric conductive material, the folded sheet having overlapping margin ends connected together by crimping.

2. The RF waveguide according to claim 1, wherein the sheet is embossed for improved bending.

3. RF waveguide according to claim 1, wherein the waveguide is a coaxial cable.

4. RF waveguide according to claim 1, wherein the sheet is corrugated.

5. RF waveguide according to claim 1, wherein the thickness of the at least a second layer lies between 10 to 100 μm.

6. RF waveguide according to claim 1, wherein the plastic foil first layer is made of a material selected from the group consisting of Polyolefin, Polyethyleneterephtalat, Polyimide, Liquid Crystal Polymer, Polycarbonate, Polyphenylenesulfide, Polytetrafluorethylene and Polyetheretherketone.

7. RF waveguide according to claim 1, wherein the plastic foil first layer is provided with additives and/or reinforcements.

8. RF waveguide according to claim 1, wherein the material of the plastic foil first layer sustains temperatures allowing soldering of the conductive material of the at least a second layer.

9. RF waveguide according to claim 1, wherein the plastic foil is provided with a fiberglass cloth.

10. RF waveguide according to claim 9, wherein the fiberglass cloth is inserted in the plastic foil.

11. RF waveguide according to claim 1, characterized by etched openings in the electric conductive material of the at least a second layer.

12. RF waveguide according to claim 1, characterized by openings in the electric conductive material of the at least a second layer achieved by silk screen process printing.

13. RF waveguide according to claim 1, wherein the at least a folded laminated sheet is wrapped with a fire proof strip or wire.

14. Method for manufacturing a RF waveguide comprising:

laminating a foil of plastic with at least one electric conductive material in order to get a combined laminated sheet with at least a first layer of a plastic foil and at least one second layer of an electric conductive material;

folding said combined, laminated sheet to a substantially cylindrical conductor having overlapping margin ends; and connecting said margin ends together by crimping.

15. Method according to claim 14, further comprising etching openings in the electric conductive material of the at least a second layer.

16. Method according to claim 14, further comprising connecting said margin ends together by crimping and hemming.

17. Method according to claim 14, further comprising forming openings in the electric conductive material of the at least a second layer by a silk screen process.

18. Method for manufacturing a RF waveguide comprising:

laminating a foil of plastic with at least one electric conductive material in order to get a combined laminated sheet with at least a first layer of a plastic foil and at least one second layer of an electric conductive material;

folding said combined, laminated sheet to a substantially cylindrical conductor having overlapping margin ends; and connecting said margin ends together by hemming.

19. Radio-Frequency (RF) waveguide comprising at least a folded laminated sheet including a first layer made of a plastic foil, and at least a second layer made of an electric conductive material, the folded sheet having overlapping margin ends connected together by hemming.

20. The RF waveguide according to claim 19 wherein the overlapping margin ends are connected together by crimping and hemming.

* * * * *